US009642452B2

(12) United States Patent
Fecheyr-Lippens et al.

(10) Patent No.: US 9,642,452 B2
(45) Date of Patent: May 9, 2017

(54) RATCHET-BASED HEIGHT ADJUSTABLE SYSTEM

(71) Applicants: JASWIG LLC, Akron, OH (US); JASWIG BVBA, Ghent (BE)

(72) Inventors: Daphne Fecheyr-Lippens, Akron, OH (US); Tyler Schimmoeller, Bryan, OH (US); Mathias Ellegiers, Akron, OH (US)

(73) Assignee: JASWIG LLC, Akron, OH (US)

( * ) Notice: Subject to any disclaimer, the term of this patent is extended or adjusted under 35 U.S.C. 154(b) by 0 days.

(21) Appl. No.: 14/734,818

(22) Filed: Jun. 9, 2015

(65) Prior Publication Data

US 2016/0360877 A1 Dec. 15, 2016

(51) Int. Cl.

| | |
|---|---|
| ***A47B 9/00*** | (2006.01) |
| ***A47B 9/06*** | (2006.01) |
| ***A47C 3/26*** | (2006.01) |

(52) U.S. Cl.

CPC . *A47B 9/06* (2013.01); *A47C 3/26* (2013.01)

(58) Field of Classification Search

CPC ..... A47B 9/06; A47C 3/26

See application file for complete search history.

(56) References Cited

U.S. PATENT DOCUMENTS 590,076 A * 9/1897 Spieth ..... A47C 3/26 248/407
1,200,693 A * 10/1916 Barton ..... A47C 3/26 248/407
1,264,609 A * 4/1918 Burness ..... A47C 3/26 248/407
1,540,616 A * 6/1925 Hagopian ..... A47C 3/26 297/311
1,699,309 A * 1/1929 Powers ..... A47C 3/26 297/344.14
2,931,685 A * 4/1960 Harold ..... A47B 17/02 108/32
3,794,397 A 2/1974 Flototto
4,032,103 A 6/1977 Ehrichs
4,469,029 A * 9/1984 Ramond ..... A47B 9/06 108/3
4,703,700 A 11/1987 Sema
5,165,755 A * 11/1992 Rho ..... A47D 1/004 248/408
5,238,292 A * 8/1993 Golenz ..... A47D 1/02 297/149
5,445,432 A * 8/1995 Chien ..... A47D 1/02 248/188.5
5,957,059 A * 9/1999 Burhman ..... A47B 21/007 108/13

(Continued)

FOREIGN PATENT DOCUMENTS

| | | |
|---|---|---|
| EP | 0003882 | 8/1981 |
| EP | 0700652 | 7/2001 |

*Primary Examiner* — Hanh V Tran

(74) *Attorney, Agent, or Firm* — DLA Piper LLP (US); Gianni Minutoli

(57) ABSTRACT

Adjustable height systems that are easy to manufacture, cost effective and simple to use. The systems use a hidden ratchet mechanism to adjust their height without introducing pinch points or other safety concerns. Moreover, because the ratchet mechanisms are hidden, they do not adversely impact the esthetics of the systems.

9 Claims, 9 Drawing Sheets

(56) References Cited

U.S. PATENT DOCUMENTS

| | | | | |
|---|---|---|---|---|
| 6,050,643 | A * | 4/2000 | Kain | A47D 1/004 297/130 |
| 6,164,218 | A * | 12/2000 | Donalson | A47B 23/007 108/144.11 |
| 6,224,516 | B1 | 5/2001 | Disch | |
| 6,312,069 | B1 * | 11/2001 | Weng | A47B 9/06 108/147 |
| 6,899,394 | B2 * | 5/2005 | Wang | A47C 3/26 297/344.2 |
| 8,596,204 | B2 * | 12/2013 | Costamagna | A47B 21/00 108/3 |
| 2003/0106614 | A1 * | 6/2003 | Noden | B25H 1/16 144/286.1 |
| 2007/0151490 | A1 | 7/2007 | Pflaster | |
| 2014/0020606 | A1 | 1/2014 | Benden | |

* cited by examiner

RATCHET-BASED HEIGHT ADJUSTABLE SYSTEM

BACKGROUND

There is a need for adjustable height systems such as e.g., adjustable height desks, tables, platform supports and stools, to name a few. Standing desks, for example, are becoming popular because studies indicate that standing while working, as opposed to sitting, is good for your health. Standing regularly engages core muscles and increases calorie burn throughout the day. Studies have also indicated that better blood and oxygen flow stimulates brain activity resulting in longer attention spans and task focus, increasing overall performance.

From a practical point of view, adjustable height systems such as adjustable height desks, tables and stools in particular, provide the convenience of using one system to accommodate users of different sizes and/or preferences. While adjustable height systems exist today, they typically require extra components (e.g., motors, chains, levers, gears, springs, complex locking mechanisms, etc.) to change their height. These extra components not only impact the visual esthetics of these systems, but also increase the costs for manufacturing them, and often require external energy. More significantly, the components and configurations of existing systems introduce "pinch points" or other safety concerns, particularly for children. Moreover, many of these systems are not that easy to use as they require the manipulation of complicated locking or other mechanisms to adjust their height.

Thus, improved adjustable height systems are desired.

SUMMARY

Embodiments disclosed herein provide adjustable height systems that are easy to manufacture, cost effective and simple to use. The disclosed embodiments use a hidden ratchet mechanism to adjust the height of the systems without introducing pinch points or other safety concerns, making the systems particularly useful and safe for children. Because the ratchet mechanisms are hidden, they do not adversely impact the esthetics of the systems. In some embodiments, the systems are designed such that their height is maintained with a simple to use locking mechanism.

In one embodiment, an adjustable height system comprises a base, a support and a top. The base comprises a first portion of at least one ratchet and the support comprises a second portion of the at least one ratchet. The top is connected to a top portion of the support and the height of the system is changed by manipulating the at least one ratchet to raise or lower the support and top.

In another embodiment, an adjustable height system comprises a first base member comprising a first portion of a first ratchet mechanism; a second base member comprising a first portion of a second ratchet mechanism; a first supporting member comprising a second portion of the first ratchet mechanism; a second supporting member comprising a second portion of the second ratchet mechanism; and a top connected to a top portion of the first and second supporting members. The height of the system is changed by manipulating the first and second ratchet mechanisms to raise or lower the first and second supporting members and the top.

A locking mechanism may be provided, the mechanism being maneuverable between a locked position preventing height adjustments to the system and an unlocked position allowing height adjustments to the system.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
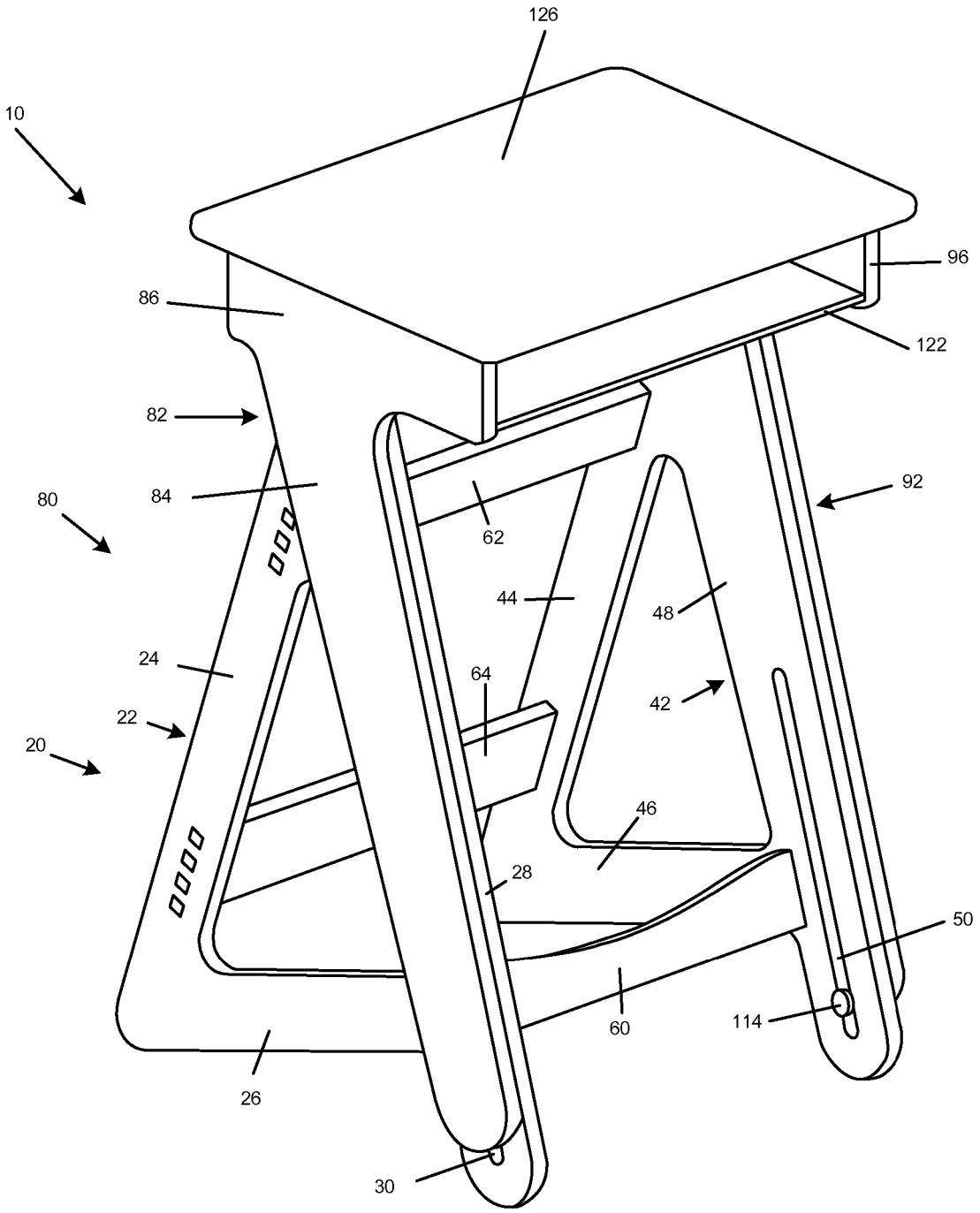
FIG. 1 illustrates a front perspective view of an example embodiment constructed in accordance with the disclosed principles.
Figure 2:
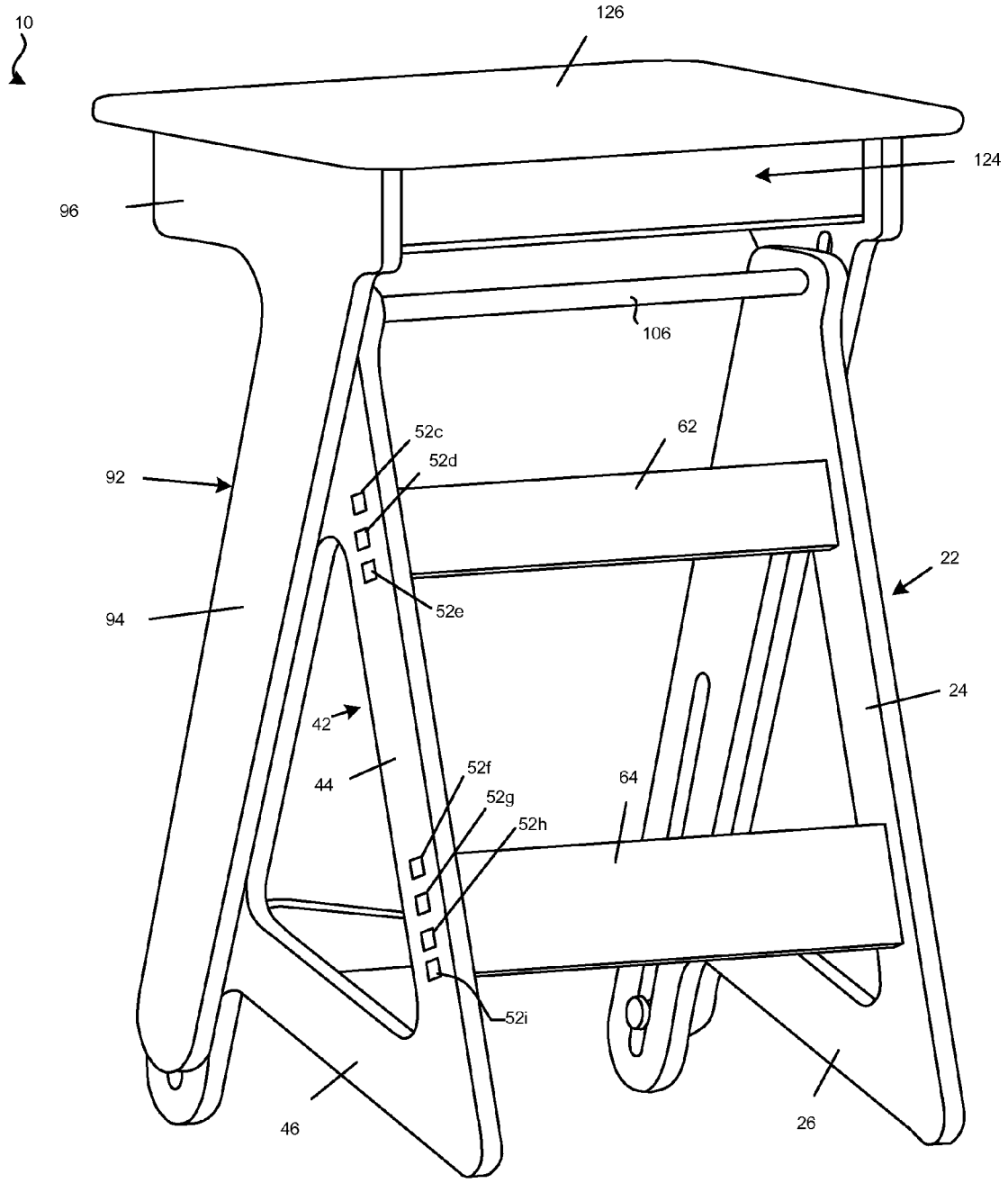
FIG. 2 illustrates a rear perspective view of the example embodiment illustrated in FIG. 1.
Figure 3:
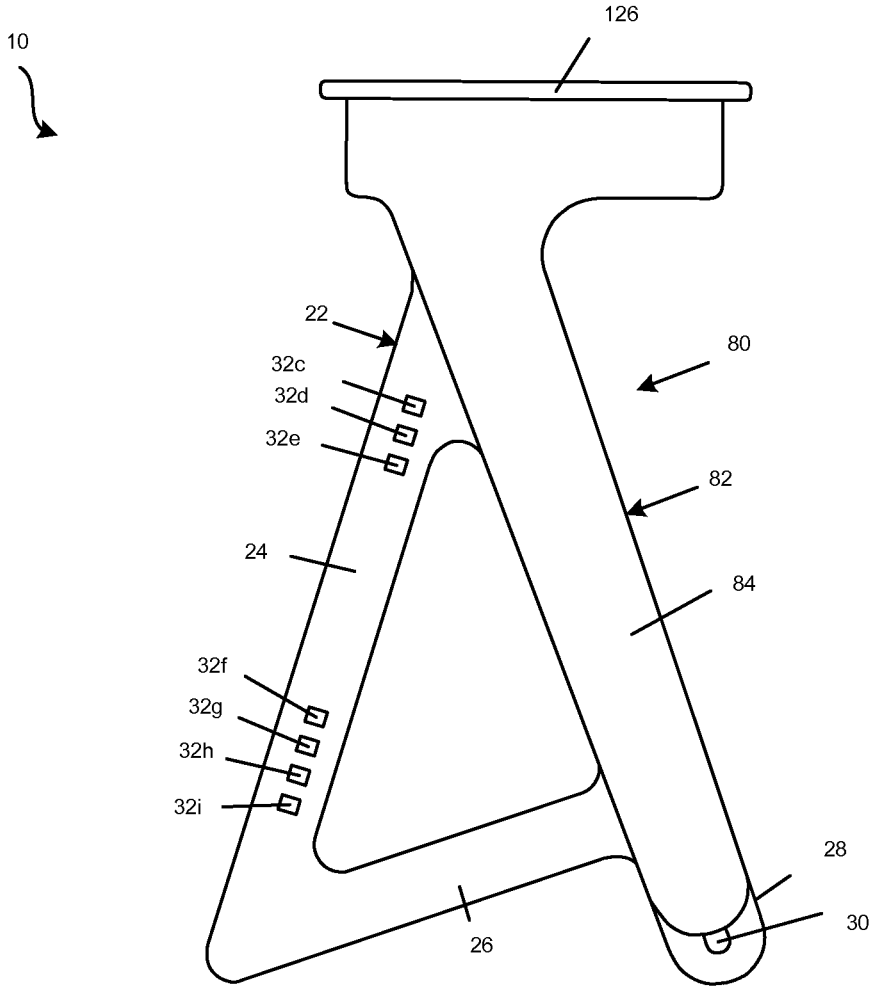
FIG. 3 a side view of the example embodiment illustrated in FIG. 1.

The following disclosure describes the various embodiments of the adjustable height systems as being a desk, standing desk, table or stool. It should be appreciated, however, that the disclosed principles can be applied to any system or device requiring an adjustable height platform or supporting mechanisms.

FIGS. 1-5 illustrate an example of a system 10 disclosed herein, implemented as an adjustable height desk such as e.g., a standing desk. The system 10 comprises a base portion 20 and a support portion 80. Connected to the support portion 80 are components (e.g., top 126, wall 124 and shelf 122) for implementing the example system 10 as a desk. As noted above, the system 10 could easily be used as a table, stool or some other type of system or device requiring an adjustable height platform or supporting mechanism.

The base portion 20 includes two base members 22, 42. The first base member 22 includes a first leg 24, second leg 28 and a brace 26 forming an elongated and slanted a-frame like structure. The top portions of the first and second legs 24, 28 are connected to each other (i.e., at the top of the a-frame like structure). The bottom portions of the first and second legs 24, 28 are connected to each other via the brace 26 (i.e., at the bottom of the a-frame like structure). In the illustrated embodiment, a portion of the second leg 28 extends past the brace 26, causing the first member 22 to be slanted in the direction of the first leg 24. It should be appreciated that the first and second legs 24, 28 and brace 26 can be formed as a single piece or separate pieces that are connected together by any known mechanism to form the shape illustrated in FIGS. 1-8. It is desired, although not required, that the point at which the first leg 24 and the brace 26 meet to be rounded as shown in the illustrated embodiment. In addition, it is desired, although not required, that the end of the second leg 28 be rounded as shown in the illustrated embodiment.

In the illustrated embodiment, the top portion of the first leg 24 includes a hole 37 formed there-through that will be sized to allow a first end of a rod 106 to pass through or be held within the leg 24. As discussed below in more detail, the rod 106 serves as a very simple, yet effective locking mechanism for the system 10. In the illustrated embodiment, the top portion of the second leg 28 will contain a stepped shaped slot 34 formed there-through. As will be discussed below in more detail with reference to FIGS. 6-8, the slot 34 is sized to accept a dowel 102 (connected to the support portion 80) and includes sloped/slanted portions 34*a*-34*f* defining positions within the slot 34 where the dowel 102 is maintained during use of the system 10. In essence, the slot 34 and corresponding dowel 102 form a ratchet used to change the height of the system 10 (discussed below in more detail). It should be appreciated that more or less portions 34*a*-34*h* may be provided for the slot 34 and that the disclosed embodiments should not be limited to the number shown in the Figures. In the illustrated embodiment, the bottom portion of the second leg 28 will contain an elongated slot 30 formed there-through. As will be discussed below in more detail with reference to FIGS. 6-8, the slot 30 is sized to allow a dowel 104 to pass there-through, which helps maintain the alignment of the second leg 28 with respect to the support portion 80.

The second base member 42 is substantially identical to the first base member 22. That is, the second base member 22 includes a first leg 44, second leg 48 and a brace 46 forming an elongated and slanted a-frame like structure. The top portions of the first and second legs 44, 48 are connected to each other (i.e., at the top of the a-frame like structure). The bottom portions of the first and second legs 44, 48 are connected to each other via the brace 46 (i.e., at the bottom of the a-frame like structure). In the illustrated embodiment, a portion of the second leg 48 extends past the brace 46, causing the second member 42 to be slanted in the direction of the first leg 44. It should be appreciated that the first and second legs 44, 48 and brace 46 can be formed as a single piece or separate pieces that are connected together by any known mechanism to form the shape illustrated in FIGS. 1-8. It is desired, although not required, that the point at which the first leg 44 and the brace 46 meet to be rounded as shown in the illustrated embodiment. In addition, it is desired, although not required, that the end of the second leg 48 be rounded as shown in the illustrated embodiment.

In the illustrated embodiment, the top portion of the first leg 44 includes a hole 57 formed there-through that will be sized to allow a second end of the rod 106 to pass through the leg 44. In the illustrated embodiment, the top portion of the second leg 48 will contain a stepped shaped slot 54 formed there-through. The slot is sized to accept a dowel 112 (connected to the support portion 80) and includes sloped/slanted portions 54*a*-54*h* defining positions within the slot 54 where the dowel 112 is maintained during use of the system 10. In essence, the slot 54 and corresponding dowel 112 form another ratchet used to change the height of the system 10. It should be appreciated that more or less portions 54*a*-54*h* may be provided for the slot 54 and that the disclosed embodiments should not be limited to the number shown in the Figures. In the illustrated embodiment, the bottom portion of the second leg 48 will contain an elongated slot 50 formed there-through. The slot 50 is sized to allow a dowel 114 to pass there-through, which helps maintain the alignment of the second leg 48 with respect to the support portion 80 (discussed below in more detail).

The two base members 22, 42 are connected to each other by three cross-members 60, 62, 64. In the illustrated embodiment, the connections between the base members 22, 42 and the cross-members 60, 62, 64 are mortise and tenon connections, which provide strong, simple and esthetically pleasing connections that do not require screws or extra components. It should be appreciated that other known connections between the base members 22, 42 and the cross-members 60, 62, 64 could be used and that the embodiments disclosed herein are not limited to the illustrated mortise and tenon connections.

Figure 4:
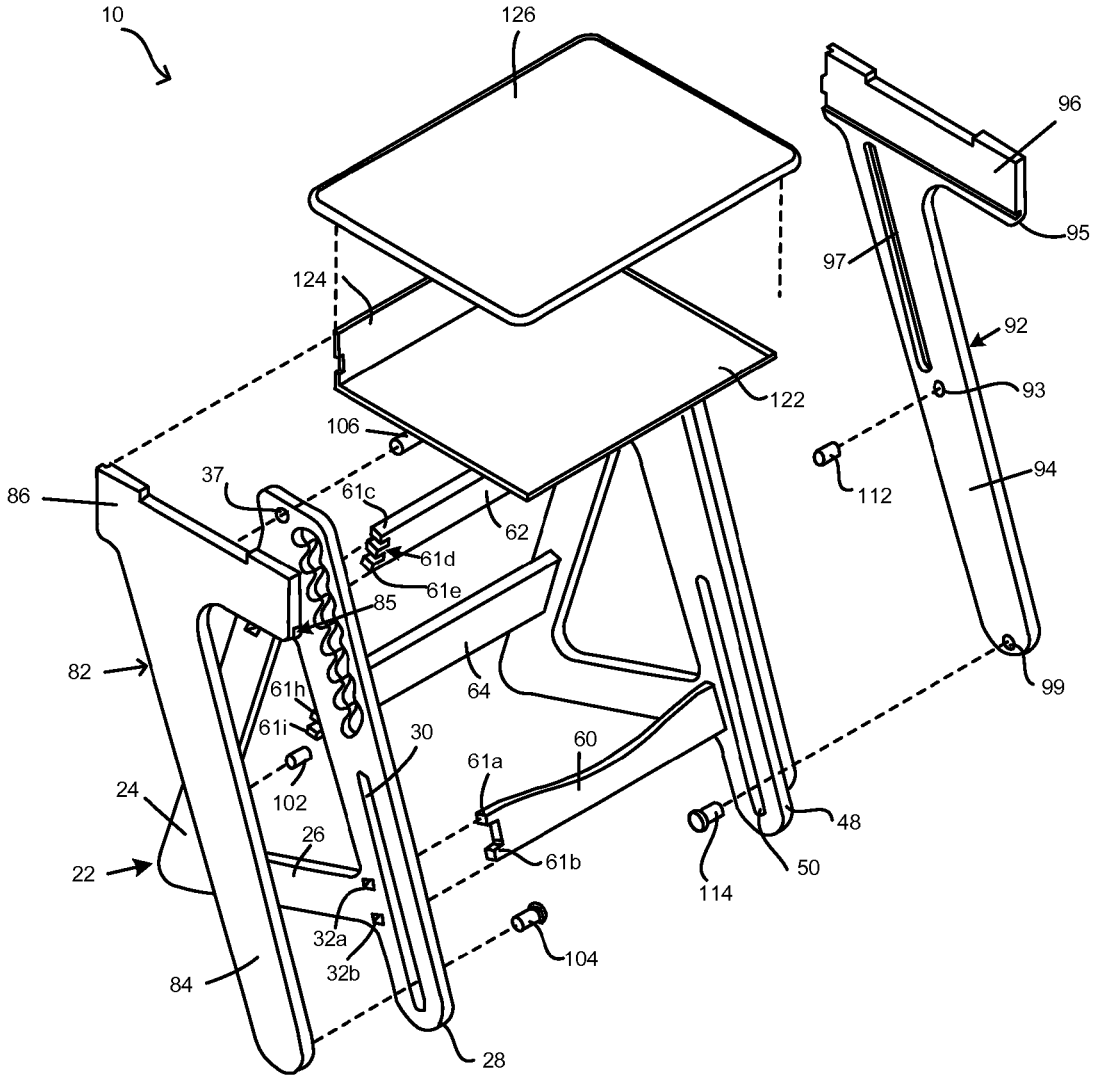
FIG. 4 is an exploded front perspective view of the example embodiment illustrated in FIG. 1.
Figure 5:
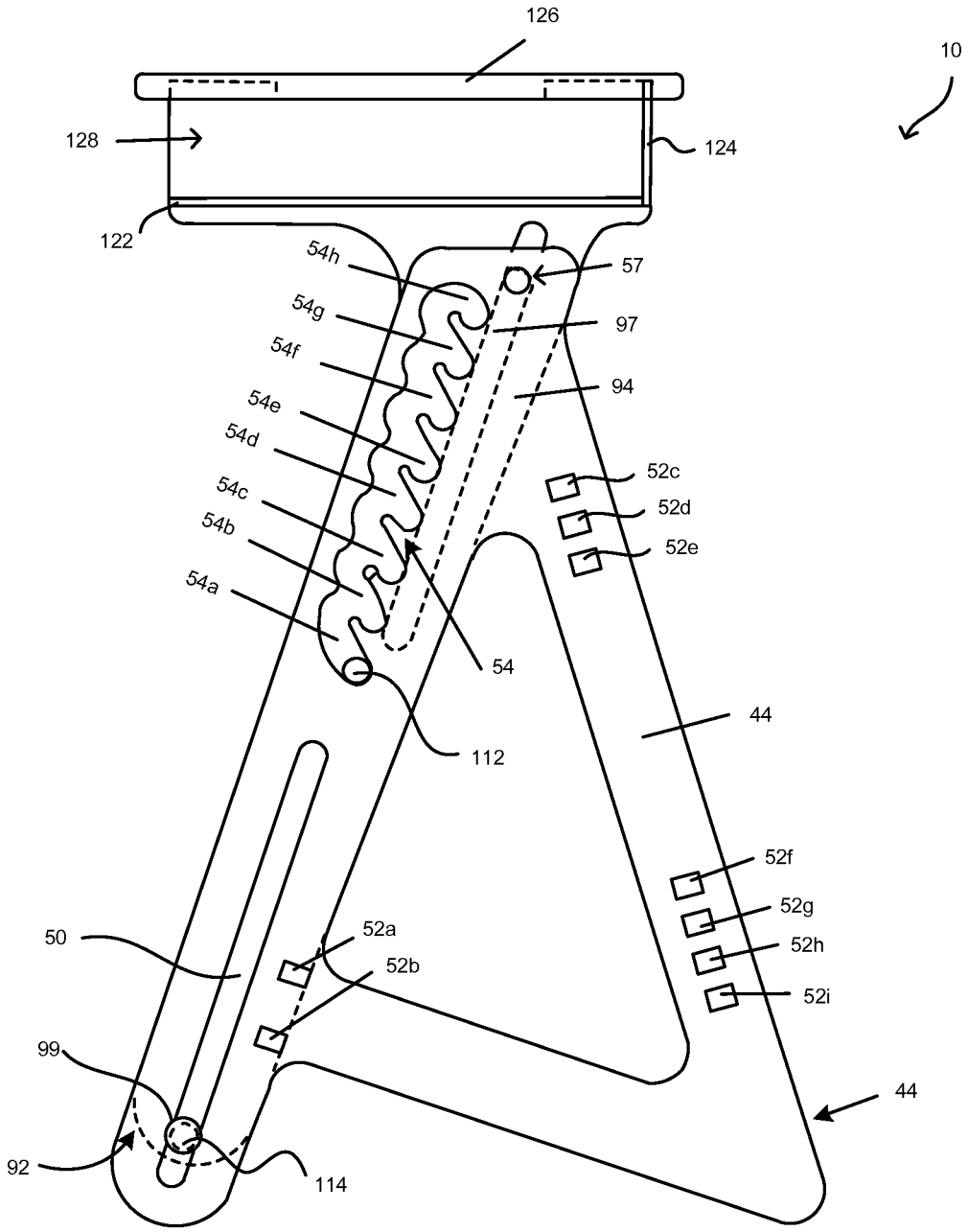
FIG. 5 is a side view showing a base member illustrated in FIG. 1 and a phantom view of a supporting member illustrated in FIG. 1 in accordance with the disclosed principles.

As shown best in FIG. 4, the first cross-member 60 has two tenons 61*a*, 61*b* formed at one end that respectively fit into corresponding mortises 32*a*, 32*b* formed in the first base member 22. In addition, the first cross-member 60 has two tenons (not shown, but similar to tenons 61*a*, 61*b*) formed at the opposite end that respectively fit into corresponding mortises 52*a*, 52*b* formed in the second base member 42. In the illustrated embodiment, the second cross-member 62 has three tenons 61*c*, 61*d*, 61*e* formed at one end that respectively fit into corresponding mortises 32*c*, 32*d*, 32*e* formed in the first base member 22. In addition, the second cross-member 62 has three tenons (not shown, but similar to tenons 61*c*, 61*d*, 61*e*) formed at the opposite end that respectively fit into corresponding mortises 52*c*, 52*d*, 52*e* formed in the second base member 42.

In the illustrated embodiment, the third cross-member 64 has four tenons (only tenons 61*h*, 61*i* are illustrated) formed at one end that respectively fit into corresponding mortises 32*f*, 32*g*, 32*h*, 32*i* formed in the first base member 22. In addition, the third cross-member 64 has four tenons (not illustrated, but similar to tenons 61*h*, 61*i*) formed at the opposite end that respectively fit into corresponding mortises 52*f*, 52*g*, 52*h*, 52*i* formed in the second base member 42. As can be appreciated, the actual number of tenons/mortises can vary and the disclosed embodiment is not limited to the number and location of tenons/mortises illustrated.

In the illustrated embodiment, the support portion 80 of the system 10 contains two supporting members 82, 92. The first supporting member 82 includes a leg 84 and a support 86. In a desired embodiment, the leg 84 is elongated and slanted in a manner similar to the way the second leg 28 of the first base member 22 is elongated and slanted. The top portion of the leg 84 is connected to a bottom surface of the support 86. It should be appreciated that the leg 84 and support 86 can be formed as a single piece or separate pieces that are connected together by any known mechanism to form the shape illustrated in FIGS. 1-8. It is desired, although not required, that the bottom portion of the leg 84 is rounded as shown in the illustrated embodiment.

The second supporting member 92 is substantially identical to the first supporting member 82. Thus, the second supporting member 92 includes a leg 94 and a support 96. In a desired embodiment, the leg 94 is elongated and slanted in a manner similar to the way the second leg 48 of the second base member 42 is elongated and slanted. The top portion of the leg 94 is connected to a bottom surface of the support 96. It should be appreciated that the leg 94 and support 96 can be formed as a single piece or separate pieces that are connected together by any known mechanism to form the shape illustrated in FIGS. 1-8. It is desired, although not required, that the bottom portion of the leg 94 is rounded as shown in the illustrated embodiment.

As best seen in FIG. 4, the leg 94 of the second supporting member 92 includes an elongated groove 97 formed therein. As can be seen from the perspective view of FIG. 2, the groove 97 does not go completely through the leg 94. In the illustrated embodiment, the groove 97 is sized to receive an end of the rod 106. The leg 94 also includes a hole 93 sized to receive a dowel 112 used to slide through the stepped slot 54 formed through the second leg 48 of the second base member 42. The dowel 112 may be glued into hole 93 to maintain it in place. In addition, the leg 94 includes a hole 99 sized to receive the dowel 114 that passes through the slot 50 formed through the second leg 48 of the second base member 42. The dowel 114 may be glued into hole 99 to maintain it in place (after being passed through the second leg 48). Moreover, the dowel 114 contains a cap portion (unnumbered) at the other end that is larger than the slot 50 and is used to keep the leg 94 and second leg 48 of the second base member 42 in alignment as discussed below in more detail with respect to FIGS. 6-8. The holes 93, 99 do not go completely through the leg 94 in the illustrated embodiment.

Figure 6:
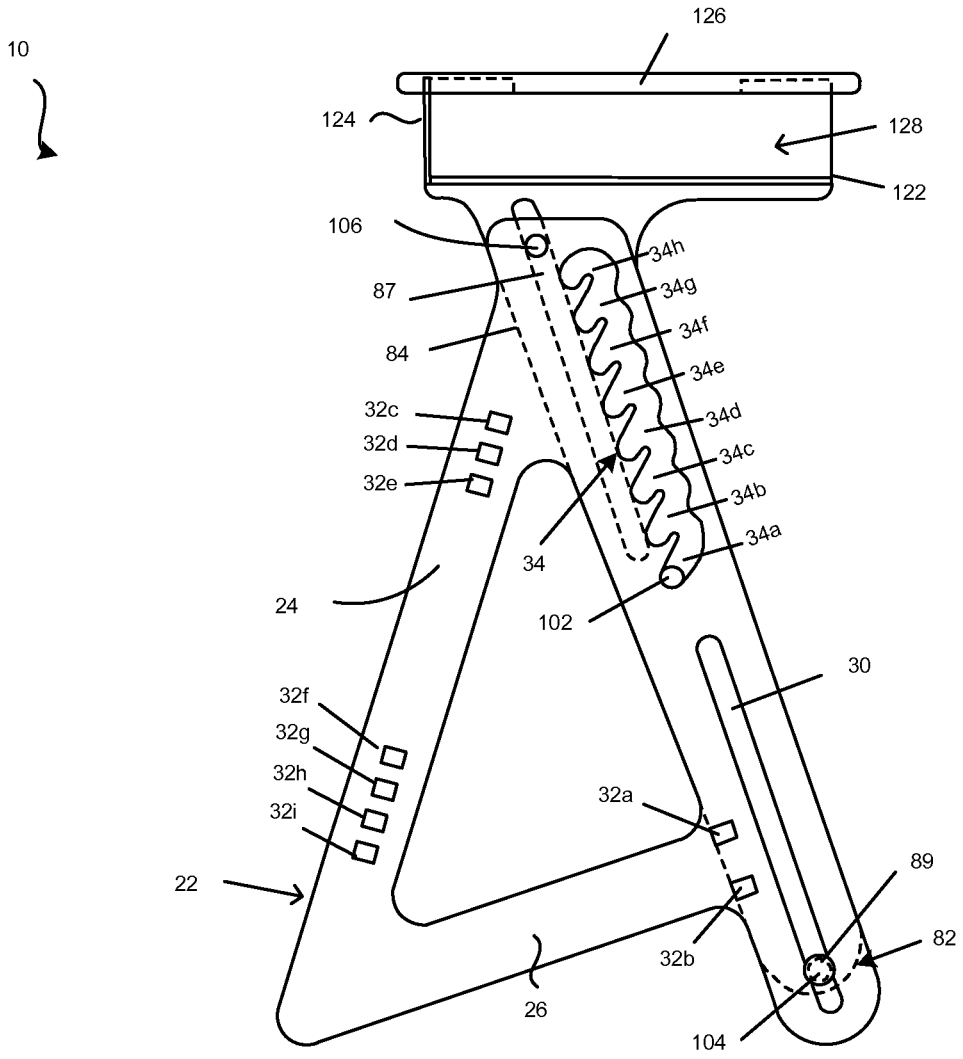
FIGS. 6-8 illustrate the example embodiment illustrated in FIG. 1 being raised from a first position to a second position in accordance with the disclosed principles.
Figure 7:
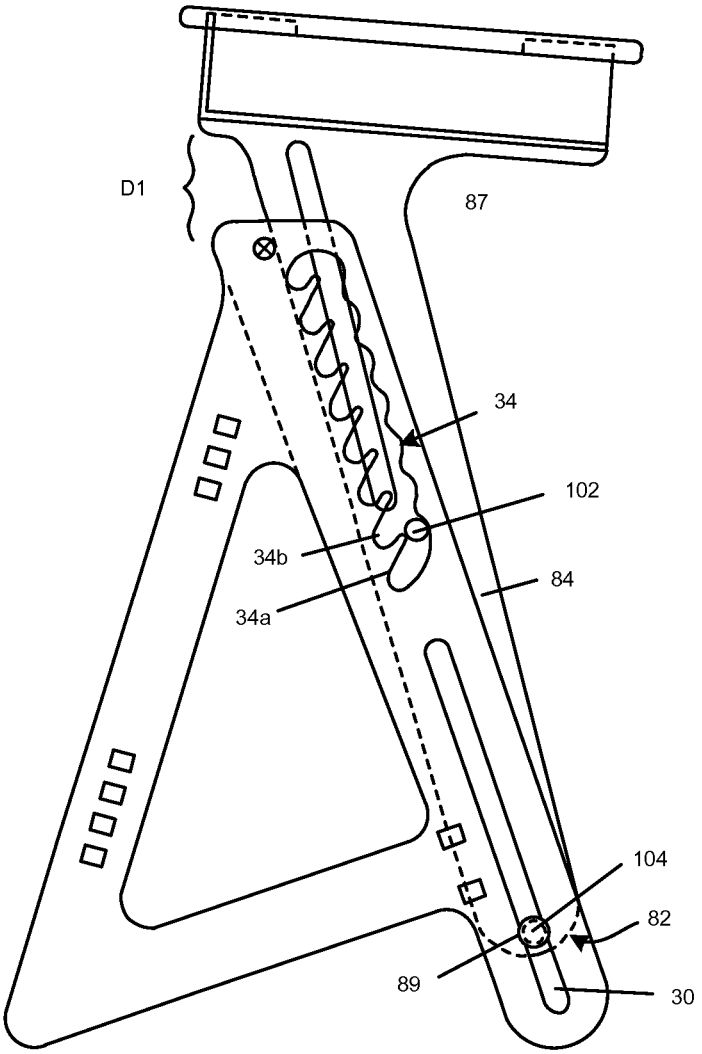
Figure 8:
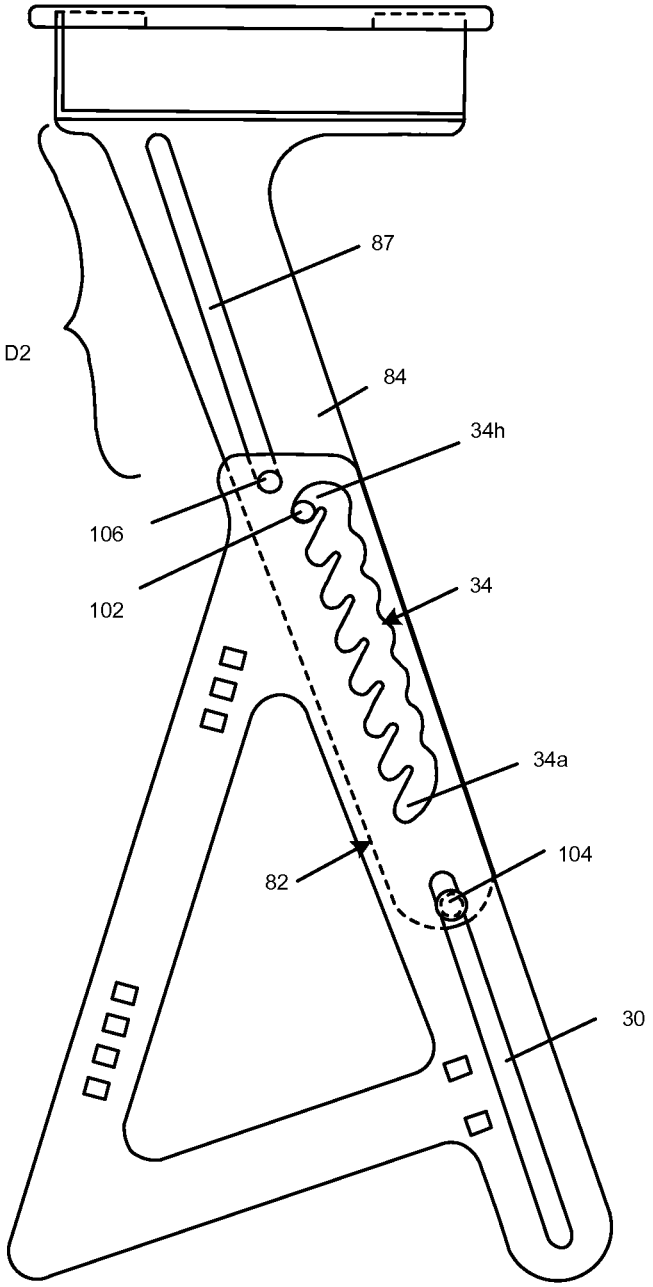

As best seen in FIGS. 7 and 8, the leg 84 of the first supporting member 82 includes an elongated groove 87 formed therein. As can be seen from the perspective view of FIG. 1, the groove 87 does not go completely through the leg 84. In the illustrated embodiment, the groove 87 is sized to receive an end of the rod 106. The leg 84 also includes a hole (not shown, but similar to hole 93) sized to receive a dowel 102 used to slide through the stepped slot 34 formed through the second leg 28 of the first base member 22. The dowel 102 may be glued into hole to maintain it in place (after being passed through the second leg 28). In addition, the leg 84 also includes a hole 89 (shown in phantom in FIGS. 6-8) sized to receive the dowel 104 that passes through the slot 30 formed through the second leg 28 of the first base member 22. The hole for dowel 104 does not go completely though the leg 84. The dowel 104 may be glued into hole 89 to maintain it in place. Moreover, the dowel 104 contains a cap portion (unnumbered) at the other end that is larger than the slot 30 and is used to keep the leg 84 and second leg 28 of the first base member 22 in alignment as discussed below in more detail with respect to FIGS. 6-8. The hole 89 does not go completely through the leg 84 in the illustrated embodiment.

In the illustrated embodiment, the system 10 includes a shelf 122. As such, the bottom portion of the support 96 of the second supporting member 92 includes an elongated groove 95 formed therein for receiving an end portion of the shelf 122. As can be seen from the perspective view of FIG. 2, the groove 95 does not go completely through the leg 94. Likewise, the bottom portion of the support 86 of the first supporting member 82 includes an elongated groove 85 (similar to groove 95) formed therein for receiving an end portion of the shelf 122. As can be seen from the perspective view of FIG. 1, the groove 95 for receiving the shelf does not go completely through the leg 84. In the illustrated embodiment, the shelf 122 is inserted within the grooves 85, 95 of the supports 86, 96. A wall 124 is connected to a back end portion of the shelf 122 and the top 126 is placed over the wall 124 and the top portions of the supports 86, 96. In the illustrated configuration, an opening 128 (i.e., a cubby hole 128) is defined by the supports 86, 96 and the shelf 122. The top 126, wall 124 and shelf 122, and their respective connections, may be maintained by an adhesive or other mechanism.

Although not required, the system 10 may include a simple locking mechanism to prevent unwanted horizontal, vertical and other movement of the support 80 portion from the base portion 20. In the illustrated embodiment, the optional locking mechanism includes a rod 106 that is passed through holes 37, 57 in the top portions of the first and second base members 22, 42. Although the illustrated embodiment has been described as having a groove 87 in the leg 84 of the first supporting member 82 and a groove 97 in the leg 94 of the second supporting member 92, the rod 106 is not long enough to reside in both grooves 87, 97 at the same time. Thus, only one groove (groove 87 or 97) is required to practice the invention. Two grooves 87, 97 may be desired to simplify the manufacturing process and to provide the user with different options for moving the rod 106 (discussed below).

The rod 106 will have a length so that it can be supported by the holes 37, 57 in the top portions of the first and second base members 22, 42, yet remain moveable between a first position whereby the rod 106 engages one of the grooves 87, 97 or a second position whereby the rod does not engage either groove 87, 97. When the rod 106 engages a groove, the system 10 is locked and its height cannot be adjusted. However, when the rod 106 is slid out of the groove and is only maintained between the holes 37, 57 in the top portions of the first and second base members 22, 42, the system 10 is unlocked and its height may be adjusted as discussed below.

The operation of the system 10 is best described with reference to FIGS. 6-8. While FIGS. 6-8 are side views showing only the first base member 22 and first supporting member 82 (portions shown in phantom), it should be appreciated that the same discussion applies to the second base member 42 and second supporting member 92. Moreover, the illustrated example includes the optional locking mechanism discussed above. It should be appreciated that if a locking mechanism is not used, then portions of the following description related to locking and unlocking the system 10 would be omitted.

FIG. 6 illustrates the system 10 with the supporting member 82 at its lowest possible position. That is, the dowel 102 attached to the first leg 84 of the first supporting member 82 is within the lowest portion 34*a* of the slot 34 formed through the second leg 28 of the first base member 22. At this point, alignment of the first leg 84 of the first supporting member 82 with respect to the second leg 28 of the first base member 22 is maintained by the dowel 104 sitting in hole 89 and passing through slot 30. In FIG. 6, the rod 106 is within groove 87 formed within the leg 84 of the first supporting member 82, which locks the system 10 into place.

As can be appreciated, unwanted horizontal, vertical and other motion is prevented by the rod 106 when it engages the groove 87 (i.e., the system 10 is in the locked position). Thus, the system 10 does not require a complex locking mechanism as is found in current and prior art height adjustments systems. This saves costs and makes the system 10 easier to use. At this point, because a locking mechanism has been used in the illustrated example, the user can only change the height of the system 10 by moving the rod 106 out of the groove 87 (so that the rod 106 is only maintained between the holes in the top portions of the first and second base members 22, 42), putting the system 10 into the unlocked position, and lifting up the support portion 80 at an angle following the angle of the legs 28, 84.

FIG. 7 illustrates the system 10 in an intermediate position as a user is manipulating the support portion 80. At this point, the rod 106 has been moved out of the groove 87, but is not engaging the other groove 97 (if present). FIG. 7 illustrates an "x" where the rod 106 was in FIG. 6. As can be seen, the leg 84 has moved slightly to the right of where the rod 106 was previously and the dowel 102 has been ratcheted up portion 32*a*, but has not yet reached portion 32*b* (or any other position in the slot 34). The top portion of the leg 84 of the first supporting member 82 has moved a distance D1 corresponding to the movement of the dowel 102. Again, alignment of the first leg 84 of the first supporting member 82 with respect to the second leg 28 of the first base member 22 is maintained by the dowel 104 sitting in hole 89 and passing through slot 30.

Ratchet-like action with slot 34 and dowel 102 continues until the user chooses the new height for the system 10. FIG. 8 illustrates the system 10 at its highest position (after the user has manipulated the support portion 80). As can be seen, the dowel 102 has been ratcheted up and into portion 32*h* in the slot 34 based on the user's actions. The top portion of the leg 84 of the first supporting member 82 has moved an overall distance D2 corresponding to the movement of the dowel 102 from the first portion 32*a* to the last portion 32*h*. Alignment of the first leg 84 of the first supporting member 82 with respect to the second leg 28 of the first base member 22 is maintained by the dowel 104 sitting in hole 89 and passing through slot 30. Because a locking mechanism has been used in the illustrated example, FIG. 8 also illustrates that the rod 106 has been put back into groove 87, locking the system 10 into place.

It should be appreciated that the system 10 utilizes a simple construction and less components than other adjustable height systems currently available or in the prior art. Thus, the disclosed system 10 is less expensive and more easy to use. The simple rod locking mechanism is but one example of a disclosed feature that is achieved in a more efficient manner, while also providing an effective and easy to manipulate user mechanism. Moreover, and perhaps most importantly, the system 10 uses hidden ratchet-like mechanisms that eliminate pinch points, making the system 10 safe and suitable for use by children. Because the ratchet mechanisms are hidden, they do not adversely impact the esthetics of the systems.

It should also be appreciated that while the illustrated embodiment contains two ratchet mechanisms (i.e., a first ratchet formed by slot 34 and dowel 102 and a second ratchet formed by slot 54 and dowel 112), the disclosed embodiments could comprise only one of the ratchet mechanisms, if desired. Thus, the height of the corresponding system would be adjusted using only the one ratchet.

Figure 9:
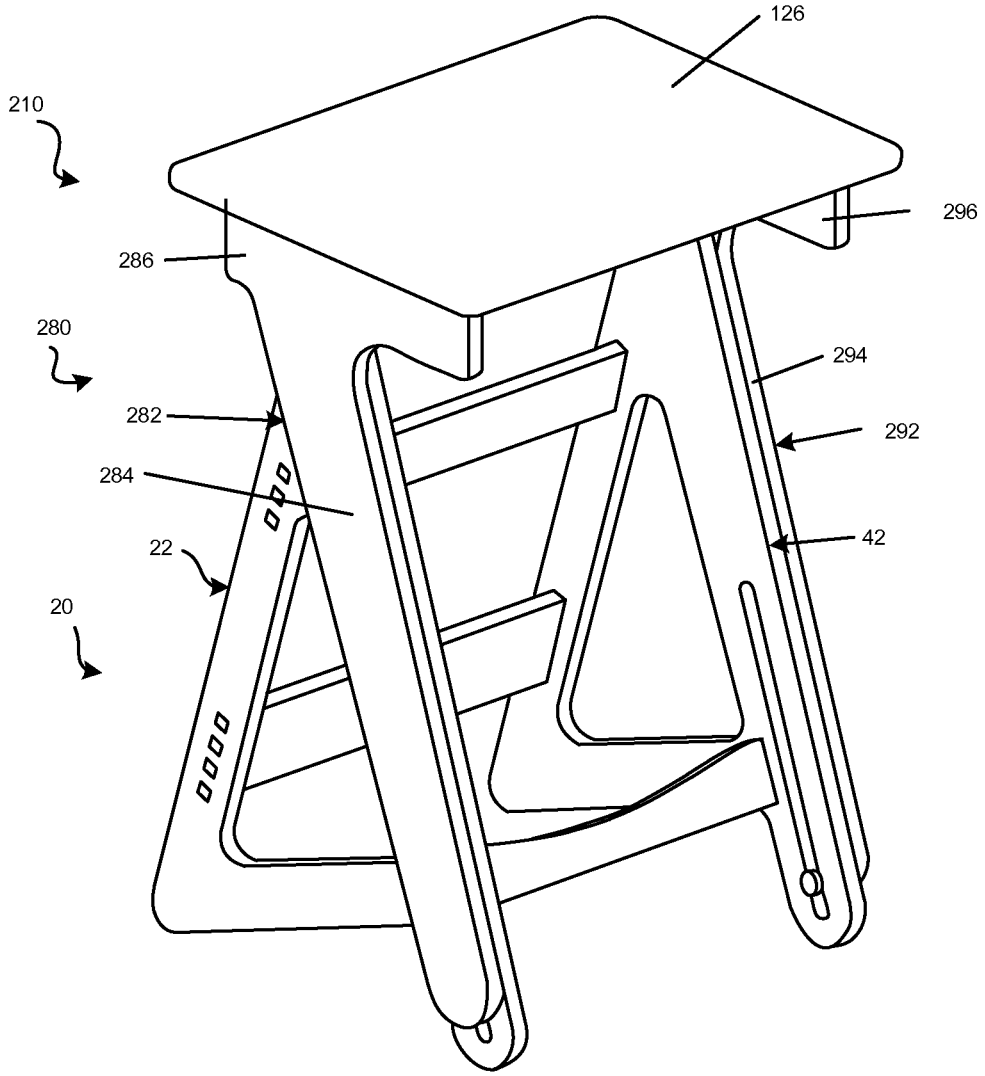
FIG. 9 illustrates a front perspective view of another example embodiment disclosed herein.

FIG. 9 illustrates an example of a system 210 disclosed herein, implemented as an adjustable height table or desk without the shelf 122 illustrated in FIG. 1. For the most part, the system 210 is substantially the same as the system 10 illustrated in FIGS. 1-8. However, because the system 210 does not include the shelf illustrated in FIG. 1, the support portion 280 may comprise supporting members 282, 292 that are slightly different than the supporting members 82, 92 illustrated in FIGS. 1-8. For example, the legs 284, 294 are connected to supports 286, 296 that do not contain a groove for accommodating a shelf. It should be appreciated that the system 210 operates in the same manner as the system 10 discussed above.

It should be appreciated that either system 10, 210 could be used as an adjustable tray (e.g., a TV dinner tray), adjustable laptop stand or platform support, to name a few, without any adjustments to the disclosed embodiments. Moreover, either system 10, 210 could be used as a stool. If desired, the stool embodiment could include a slanted seat (as opposed to the top 126 and shelf 122 illustrated in the Figures) or a backrest.

In the illustrated embodiment, the systems 10, 210 are made of wood (e.g., a hardwood), plywood or other forms of composite wood. One suitable hardwood for the systems 10, 210 is birch due to its strength and appearance. It should be appreciated that the systems could comprise other types of wood, wood composites, plastics, other composites or even metal and that the disclosed embodiments are not limited to a particular type of material. It should also be appreciated that adhesives and bonding materials could be used where appropriate to strengthen connections and joints.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. An adjustable height system comprising:

a base comprising a first portion of at least one ratchet and a first alignment mechanism, said first alignment mechanism being spaced apart from and configured in alignment in a substantially vertical direction with the first portion of the at least one ratchet;

a support over the base, the support comprising a second portion of the at least one ratchet and a second alignment mechanism, said second alignment mechanism for engaging with the first alignment mechanism and being spaced apart from and configured in alignment in a substantially vertical direction with the second portion of the at least one ratchet; and a top connected to a top portion of the support, wherein a height of the system is changed by manipulating the at least one ratchet to raise or lower the support and top, engagement of the second alignment mechanism with the first alignment mechanism keeping the support in alignment with the base during the raising or lowering of the support and top, wherein the first alignment mechanism comprise a slot formed through the base and the second alignment mechanism is a component connected to the support and for sliding within the slot.

2. The system of claim 1, wherein the first portion of the at least one ratchet comprises a slot comprising a plurality of slot portions defining positions within the at least one ratchet and wherein the second portion of the at least one ratchet comprises a component for engaging one of the slot portions.

3. The system of claim 2, wherein the component for engaging one of the slot portions comprises a dowel connected to the support.

4. The system of claim 1, wherein the system comprises one of an adjustable height desk, table, stool or platform support.

5. An adjustable height system comprising:

a first base member comprising a first leg connected to a second leg by a brace forming a slanted A-frame structure, said second leg comprising a first portion of a first ratchet mechanism and a first portion of a first alignment mechanism, said first portion of said first alignment mechanism being spaced apart from and configured in alignment in a substantially vertical direction with the first portion of the first ratchet mechanism;

a second base member comprising a first leg connected to a second leg by a brace forming a slanted A-frame structure, said second leg comprising a first portion of a second ratchet mechanism and a first portion of a second alignment mechanism, said first portion of said second alignment mechanism being spaced apart from and configured in alignment in a substantially vertical direction with the first portion of the second ratchet mechanism, the first base member being connected to the second base member by a plurality of cross-members;

a first supporting member over the first base member, the first supporting member comprising a slanted leg having a second portion of the first ratchet mechanism and a second portion of the first alignment mechanism, said second portion of said first alignment mechanism being spaced apart from and configured in alignment in a substantially vertical direction with the second portion of the first ratchet mechanism;

a second supporting member over the second base member, the second supporting member comprising a slanted leg having a second portion of the second ratchet mechanism and a second portion of the second alignment mechanism, said second portion of said second alignment mechanism being spaced apart from and configured in alignment in a substantially vertical direction with the second portion of the second ratchet mechanism; and a top connected to a top portion of the first and second supporting members, wherein a height of the system is changed by manipulating the first and second ratchet mechanisms to raise or lower the first and second supporting members and the top, wherein the first portion of at least one of the first and second alignment mechanisms comprises a slot formed through at least one of the first and second base members and the second portion of the at least one of the first and second alignment mechanisms comprises a component connected to the at least one of the first and second supporting members and for sliding within the slot.

6. The system of claim 5, wherein the first portions of the first and second ratchet mechanisms comprise a slot comprising a plurality of slot portions defining positions within the first and second ratchet mechanisms, and the second portions of the first and second ratchet mechanisms comprise a component for engaging one of the slot portions.

7. The system of claim 5, wherein the first portions of the first and second alignment mechanisms comprise slots respectively formed through the first and second base members and the second portions of the first and second alignment mechanisms comprise components connected to the first and second supporting members and for sliding within the slots.

8. The system of claim 5, wherein the system comprises one of an adjustable height desk, table, stool or platform support.

9. The system of claim 5 wherein the system comprises a desk and the system further comprises a shelf supported by the first and second supporting members and spaced from the top.

* * * * *